US006572051B1

(12) United States Patent
Stude

(10) Patent No.: US 6,572,051 B1
(45) Date of Patent: Jun. 3, 2003

(54) ROLL REPLACEMENT FACILILATOR

(76) Inventor: Michael Stude, 1021 S. Grove Ave., Barrington, IL (US) 60010

( * ) Notice: Subject to any disclaimer, the term of this patent is extended or adjusted under 35 U.S.C. 154(b) by 0 days.

(21) Appl. No.: 10/131,107

(22) Filed: Apr. 24, 2002

(51) Int. Cl.[7] ..... B65H 75/18
(52) U.S. Cl. ..... 242/598.2
(58) Field of Search ..... 242/598.3, 598.6, 242/599.1, 599.3

(56) References Cited

U.S. PATENT DOCUMENTS

| | | | | | |
|---|---|---|---|---|---|
| 1,045,311 | A | * | 11/1912 | Moberg | 242/599.1 |
| 2,253,664 | A | * | 8/1941 | Vigo | 242/599.1 |
| 2,434,556 | A | | 1/1948 | Foltis | |
| 2,486,607 | A | | 11/1949 | Laystrom et al. | |
| 2,522,109 | A | | 9/1950 | Foltis | |
| 2,639,939 | A | | 5/1953 | Matchett | 299/24 |
| 2,801,809 | A | * | 8/1957 | Glaner | 242/599.1 |
| 2,873,928 | A | | 2/1959 | Klasky | |
| 2,889,122 | A | * | 6/1959 | McConnell | 242/599.1 |
| 3,037,718 | A | * | 6/1962 | Pettit | 242/598.3 |
| 3,239,158 | A | | 3/1966 | Levesque | |
| 3,362,653 | A | * | 1/1968 | Carlisle | 242/599.1 |
| 3,392,928 | A | | 7/1968 | Peterson | |
| 3,633,838 | A | * | 1/1972 | Krueger | 242/599.1 |
| 3,643,884 | A | | 2/1972 | Curtin | |
| 4,191,342 | A | | 3/1980 | Reinhold | |
| 4,383,656 | A | * | 5/1983 | Campbell | 242/598.3 |
| D296,963 | S | | 8/1988 | Smallwood | D6/523 |
| 5,381,984 | A | * | 1/1995 | Hindsgual | |
| 5,494,218 | A | | 2/1996 | Armand | 239/52 |
| 5,598,987 | A | * | 2/1997 | Wachowicz | |
| 5,727,751 | A | * | 3/1998 | Liu | 242/599.1 |
| D405,305 | S | | 2/1999 | Hobgood | D6/523 |
| 6,431,493 | B1 | * | 8/2002 | Stauner | 242/598.3 |

* cited by examiner

*Primary Examiner*—William A. Rivera
(74) *Attorney, Agent, or Firm*—Thomas R. Vigil; Welsh & Katz, Ltd.

(57) ABSTRACT

The combination with, a mandrel assembly comprising first and second telescoping tubes which are biased outwardly from each other by a spring mechanism located between them, and the mandrel assembly being releasably mounted in a holder for holding a roll of material, the holder including a base and spaced apart, outwardly extending first and second legs, each having a selected width, the mandrel assembly being releasably mounted between the legs, a removable plate structure including a plate having an outer surface and an inner surface and having structure for removable mounting the plate onto one end of the mandrel assembly and the plate having an areal extent which extends beyond the width of the adjacent leg, whereby a user can easily engage the outer surface of the plate adjacent one leg with a thumb or finger and push the plate toward the other leg to compress the telescoping tubes to remove and replace a used up roll of material.

20 Claims, 2 Drawing Sheets

FIG. 1
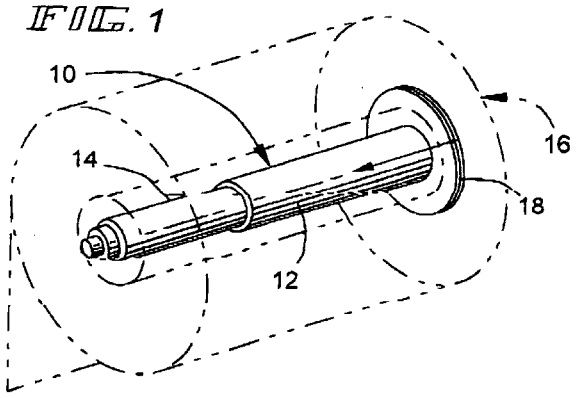
FIG. 3
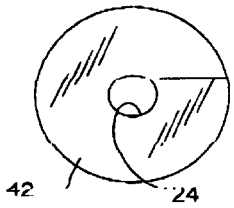
FIG. 4
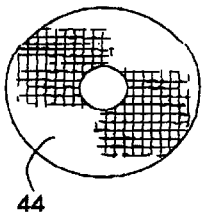
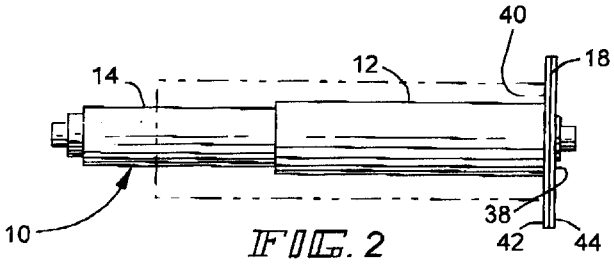
FIG. 2
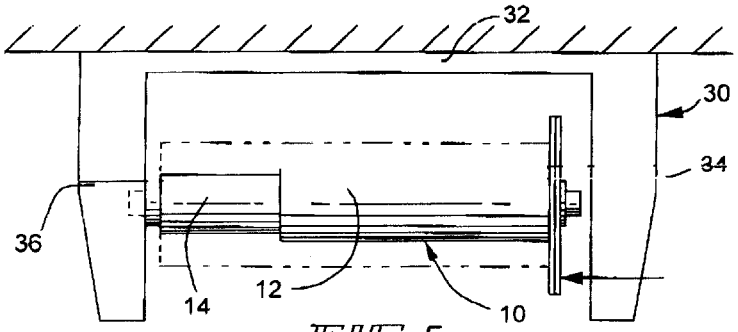
FIG. 5
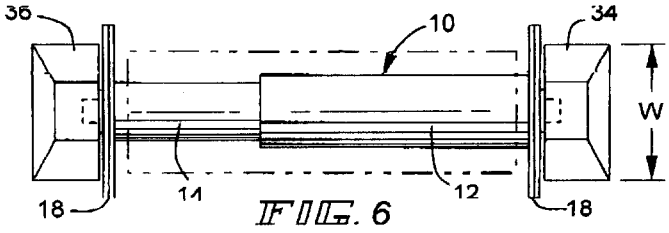
FIG. 6

FIG. 7
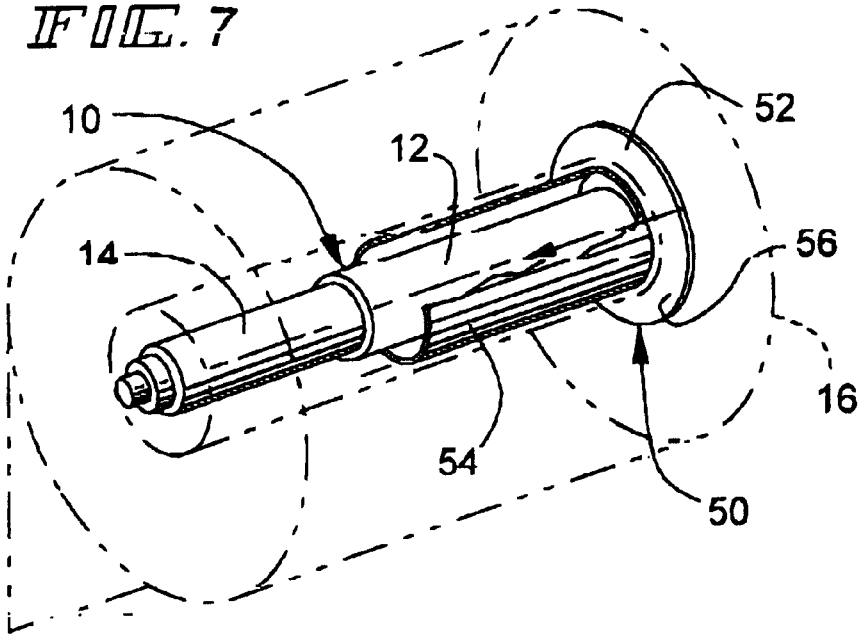
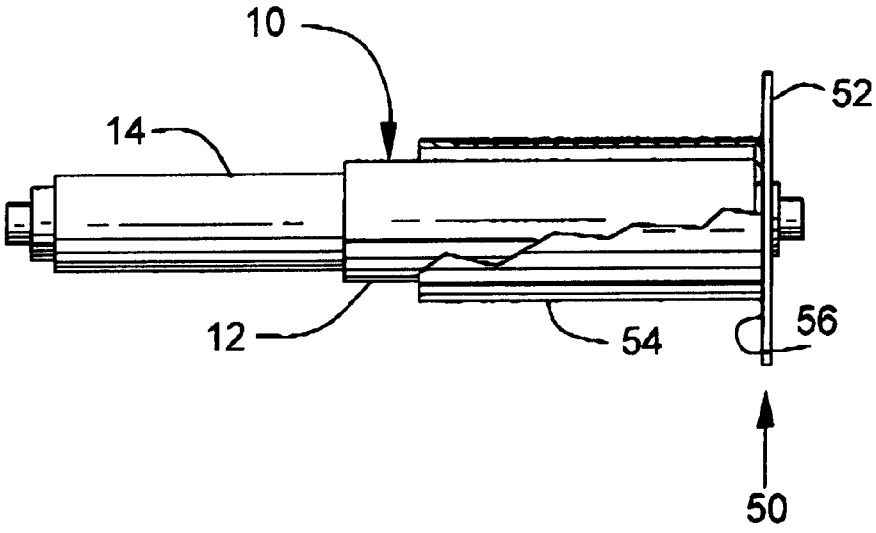
FIG. 8

ROLL REPLACEMENT FACILILATOR

BACKGROUND OF THE INVENTION

1. Field of the Invention

The present invention relates to a device for facilitating replacement of a roll of material, such as a toilet paper roll, where the roll is held on a mandrel assembly including a telescoping tube assembly in which a first tube is received in a second tube and a spring is located between them to bias the tubes away from each other. The roll replacement facilitating device of the present invention facilitates compression of the spring and movement of the second tube toward the first tube so that the tube assembly can be removed from a holder to insert a new roll of material on the mandrel assembly.

2. Description of the Prior Art

Heretofore various mandrel or telescoping tube assemblies have been proposed for holding a roll of material, such as a toilet paper roll. Also some of these mandrel or tube assemblies have included a radially projecting flange or tab extending radially outwardly from one of the tubes to facilitate movement of one tube against another tube of the mandrel or tube assembly. These prior structures require a special construction of one or both of the telescoping tubes and do not include a structure which can be mounted on or used with a conventional tube or mandrel assembly for a toilet paper roll. Also, there have been proposed, a mandrel or tube assemblies which permit the mounting of fragrance dispensing materials in the mandrel or tube assembly.

Some examples of previously proposed mandrel or tube assemblies for mounting a toilet paper roll and assemblies for dispensing a fragrance from the tube or mandrel assembly are disclosed in the following analogous and non-analogous U.S. Patents:

| U.S. Pat. No. | Patentee |
|---|---|
| 2,434,556 | Foltis |
| 2,486,607 | Laystrom et al. |
| 2,522,109 | Foltis |
| 2,639,939 | Matchett |
| 2,837,928 | Klasky |
| 3,239,158 | Levesque |
| 3,392,928 | Peterson |
| 3,643,884 | Curtin |
| 4,191,342 | Reinhold |
| 5,494,218 | Armand |
| Des. 296,963 | Smallwood |
| Des. 405,305 | Hobgood |

BRIEF SUMMARY OF THE INVENTION

According to the present invention there is provided for use in, or in combination with, a mandrel assembly comprising first and second telescoping tubes which are biased outwardly from each other by a spring mechanism located between them, and the mandrel assembly being releasably mounted in a holder for holding a roll of material, the holder including a base and spaced apart, outwardly extending first and second legs, each having a selected width, the mandrel assembly being releasably mounted between the legs, a removable plate structure including a plate having an outer surface and an inner surface and having structure for removable mounting the plate onto one end of the mandrel assembly and the plate having an areal extent which extends beyond the width of the adjacent leg, whereby a user can easily engage the outer surface of the plate adjacent one leg with a thumb or finger and push the plate toward the other leg to compress the telescoping tubes to remove and replace a used up roll of material.

DESCRIPTION OF THE SEVERAL VIEWS OF THE DRAWINGS

FIG. 1 is a perspective view of a conventional tube or mandrel assembly for mounting a toilet paper roll, shown in phantom, and shows a plate of the present invention mounted at an outer end of the tube or mandrel assembly;

FIG. 2 is a front plan view of the tube or mandrel assembly and plate of the present invention removed from a holder and showing first and second tubes of the assembly in an expanded position;

FIG. 3 is a plan view of one side of the plate and is taken along line 3—3 of FIG. 2;

FIG. 4 is a plan view of the other side of the plate and is taken along line 4—4 of FIG. 2;

FIG. 5 is a top plan view of the tube or mandrel assembly mounted in a U-shaped holder fixed to a wall and shows the movement of the plate by a finger of a person to move the tube assembly telescopically toward the leg on the other side of the holder, thereby to facilitate removal of the tube or mandrel assembly and the mounting of a new roll of material on the tube assembly;

FIG. 6 is a front elevational view of the holder and tube assembly shown in FIG. 5 and is taken along line 6—6 of FIG. 5 and shows employment of a second plate if desired on the other end of the tube assembly.

FIG. 7 is a perspective view of a conventional tube or mandrel assembly for mounting a toilet paper roll, shown in phantom, and shows a modified plate structure of the present invention mounted at an outer end of the tube or mandrel assembly;

FIG. 8 is a front plan view of the tube or mandrel assembly and the modified plate structure of the present invention removed from a holder and showing first and second tubes of the assembly in an expanded position and a sleeve extending from the plate and over at least part of one of the tubes.

DETAILED DESCRIPTION OF THE INVENTION

Referring now to the drawings in greater detail there is illustrated in FIG. 1 a mandrel or tube assembly 10 comprising a first larger tube 12 and a second smaller tube 14. Hidden from view within the tubes 12 and 14 is a spring such that the first and second tubes 12 and 14 are urged away from each other by the compressive force of the spring. This structure is conventional and forms no part of the present invention.

As shown in phantom, a roll 16 of toilet paper is positioned on the tube assembly 10.

According to the teachings of the present invention, at least one plate 18, which, in the illustrated embodiment is a laminated disc 18, is positioned on a stepped shoulder 20 at the end of the larger tube 12. While the disc 18 is shown mounted on a stepped shoulder of the larger tube 12, it alternatively can be mounted on a stepped shoulder 22 of the smaller tube 14. The plate or disc 18 is constructed with a hole 24, which is sized to fit over and on the shoulder 20 and/or 22.

With reference to FIG. 5, it will be appreciated that a user can engage the plate or disc 18 with a forefinger to move the first larger tube 12 telescopingly over the smaller tube 14 to compress the tube assembly 10 to facilitate removal of the tube assembly 10 from a U-shaped holder 30 for removal of the used roll 16 and insertion of a new roll 16 of toilet paper on the tube assembly 10 and into the holder 30.

The holder 30 includes a base 32 for mounting on a wall and spaced apart, outwardly extending legs 34 and 36. The legs 34, 36 each have a width which is less than the diameter of the disc shaped plate 18 so that the plate 18 extends beyond the adjacent leg 34 or 36 to expose part of an outer surface 38 of the plate 18 which also has an inner surface 40.

While the plate or disc 18 can be made of several different materials including wood, cardboard, rubber, plastic, and metal, a stiff plastic material is preferred for the inner ply 42. The embodiment illustrated in the drawings includes the stiff inner ply 42 and a softer outer ply 44, such as a fabric ply, which easily can be impregnated with a fragrance, a deodorizing substance or an air freshener for neutralizing odors.

Also, it will be understood that the plate 18 can be made of one material only, with or without impregnation with a fragrance or deodorizer.

The outer disc or ply 44 of fabric material can be made of any fiber which will hold a fragrance such as an animal fiber or hair, a vegetable fiber (e.g. cotton) or a plastic fiber.

As shown in FIG. 6, two discs or plates 18 can be employed, one at each end of the tube assembly 10. This will facilitate compression of the tube assembly since a user can engage one plate 18 with a forefinger and the other plate 18 with a thumb and squeeze to remove the tube assembly 10 from the holder 30. However, this modified construction will require removal of one of the discs 18 for insertion of a roll 16 of toilet paper.

The construction shown in FIGS. 1, 2 and 5, is preferred since it enables easy removal of the used paper roll 16 and replacement with a new paper roll 16 simply by engaging the plate 18 with the forefinger and one leg 34 or 36 of the holder 30 with the thumb and squeezing to compress the tube assembly 10 for facilitating its removal.

Also it will be understood that while a circular plate or disc 18 is illustrated in the drawings, the plate 18 can have a shape selected from one of: circular, square, rectangular, a geometric design or the two dimensional shape of a creature or character.

In FIGS. 7 and 8 is illustrated a modified plate structure 50 which includes at least one stiff plate 52 and a sleeve 54 fixed to and extending from an inner surface 56 of the plate 52. The sleeve 54 has an inner diameter which will fit over at least part of the tube assembly 10 and with the cardboard roll of a toilet paper roll 16. In this constuction, the sleeve 54 and not a hole 24 in the plate or disc 18, forms a means for mounting the plate structure 50 on a tube assembly 10.

From the foregoing description it will be appreciated that the combination tube assembly 10 and plate 18 or plate structure 50 of the present invention, provides a number of advantages some of which have been described above and others of which are inherent in the invention. For example, the disc shaped plate 18 facilitates easy compression of the tube assembly 10 and removal of the tube assembly 10 from the holder 30 for replacing a roll 16 of material on the tube assembly 10. The disc shaped plate 18 can be used with any conventional tube assembly or mandrel assembly 10 for holding a roll 16 of toilet paper as long as the disc 18 has an outer diameter which extends beyond the width of the adjacent leg 34 or 36 of a holder 30, as shown in FIG. 6, and has an inner diameter hole 24 which is sized to be receive over a step or shoulder 20 or 22 at one end of one tube 12 or 14 of a tube assembly 10 for holding a toilet paper roll 16. This facilitates use of the plate or disc 18 with existing mandrel or tube assemblies 10 for holding a toilet paper roll 16.

Still further, the disc 18 can be stiff, of one piece construction and impregnated with an air freshener or fragrance for neutralizing odors in the bathroom. In one preferred embodiment, the disc 18 is a laminated assembly 18 comprising a stiff inner disc 42 and a fragrance impregnated outer fabric disc 44.

It will be understood that when a fragrance impregnated plate or plate assembly 18 is utilized, different fragrances can be provided and after a period of use can be replaced with a new disc 18 with the same or new fragrance.

Furthermore, as shown in FIG. 6 two disc or disc assemblies can be utilized to facilitate compression of the tube assembly.

Also, it should be understood that modifications can be made to the combination tube assembly 10 and plate 18 or plate structure 50 of the present invention without departing from the teaching of the present invention. For example, while a circular plate or plate structure is illustrated in the figures of the drawings, the shape of the disc can be altered as desired to a square shape or to the shape of a selected geometrical design or to the two dimensional shape of a creature or character.

Also, the plate 18 can have a larger than required hole 24 and an annular rubber disc can be added having an outer diameter substantially the same as or larger than the hole 24 and having an inner diameter sized to frictionally fit over a shoulder 20 or 22 at the end of one of the tubes 12 or 14. In this way, the plate 18 can be fixed frictionally to the shoulder 20 or 22. Stated otherwise, this construction facilitates a friction fit of the plate 18 on a shoulder 20 or 22.

Accordingly, the scope of the invention is only to be limited as necessitated by the accompanying claims.

I claim:

1. For use in a mandrel assembly comprising first and second telescoping tubes which are biased outwardly from each other by a spring mechanism located between them, and the mandrel assembly being releasably mounted in a holder for holding a roll of material, the holder including a base and spaced apart, outwardly extending first and second legs, each having a selected width, the mandrel assembly being releasably mounted between the legs, a removable plate structure including a plate having an outer surface and an inner surface and having means for removable mounting said plate onto one end of the mandrel assembly, said plate having an areal extent which extends beyond the width of the adjacent leg, whereby a user can easily engage said outer surface adjacent one leg with a thumb or finger and push the plate toward the other leg to compress the telescoping tubes to remove and replace a used up roll of material, and, at least a part of, said plate structure being permeable to a scent, fragrance or deoderizer and having therein one of a scent, a fragrance and a deodorizer.

2. The plate structure of claim 1 comprising at least a two ply plate including a a fragrance permeable plate.

3. The plate structure of claim 2 wherein said permeable plate is made of a woven material.

4. The plate structure of claim 1 having a shape selected from one of: circular, square, rectangular, a geometric design and the two dimensional shape of a creature or character.

5. The plate structure of claim of 1 wherein said means for mounting is a hole in said plate having a lateral extent which fits on a stepped shoulder at an outer end of one of the telescoping tubes.

6. The plate structure of claim 1 wherein said means for mounting comprises a sleeve which is fixed to and extends from said inner surface of said plate for being received at least part way over one of the telescoping tubes.

7. The plate structure of claim 1 being made, at least in part, of one of cardboard, metal, plastic, rubber, wood, cloth and glass.

8. The plate structure of claim 1 wherein said plate structure includes one of a rubber or soft plastic disc which is sized to provide a friction fit on a shoulder at one end of one of said tubes.

9. The plate structure of claim one being of one piece or unitary construction.

10. A combination comprising a mandrel assembly including first and second telescoping tubes which are biased outwardly from each other by a spring mechanism located between them, the mandrel assembly being releasably mounted in a holder for holding a roll of material, the holder including a base and spaced, apart, outwardly extending first and second legs, each having a selected width, the mandrel assembly being releasably mounted between the legs, and a removable plate structure including a plate having an outer surface and an inner surface and having means for removeably mounting said plate onto one end of the mandrel assembly, said plate having an areal extent which extends beyond the width of the adjacent leg, whereby a user can easily engage said outer surface adjacent one leg with a thumb or finger and push the plate toward the other leg to compress the telescoping tubes to remove a used up roll of material, and, at least a part of, said plate structure being permeable to a scent, fragrance or deoderizer and having therein one of a scent, a fragrance and a deodorizer.

11. The combination of claim 10 wherein said plate structure comprises at least a two ply plate including a fragrance permeable plate.

12. The combination of claim 11 wherein said permeable plate is made of a woven material.

13. The combination of claim 10 wherein said plate structure has a shape selected from one of: circular, square, rectangular, a geometric design and the two dimensional shape of a creature or character.

14. The combination of claim 10 wherein said means for mounting is a hole in said plate having a lateral extent which fits on a stepped shoulder at an outer end of one of the telescoping tubes.

15. The combination of claim 10 wherein said means for mounting comprises a sleeve which is fixed to and extends from said inner surface of said plate for being received at least part way over one of the telescoping tubes.

16. The combination of claim 10 wherein said plate structure is made of one of cardboard, metal, plastic, rubber, wood, cloth and glass.

17. The combination of claim 10 wherein said plate structure includes one of a rubber or soft plastic disc which is sized to provide a friction fit on a shoulder at one end of one of said tubes.

18. The combination of claim 10 wherein said plate structure is of one piece or unitary construction.

19. For use in a mandrel assembly comprising first and second telescoping tubes which are biased outwardly from each other by a spring mechanism located between them, and the mandrel assembly being releasably mounted in a holder for holding a roll of material, the holder including a base and spaced apart, outwardly extending first and second legs, each having a selected width, the mandrel assembly being releasably mounted between the legs, a removable plate structure including a plate having an outer surface and an inner surface and having means for removable mounting said plate onto one end of the mandrel assembly, said plate having an areal extent which extends beyond the width of the adjacent leg, whereby a user can easily engage said outer surface adjacent one leg with a thumb or finger and push the plate toward the other leg to compress the telescoping tubes to remove and replace a used up roll of material, and said means for mounting comprises a sleeve which is fixed to and extends from said inner surface of said plate for being received at least part way over one of the telescoping tubes.

20. A combination comprising a mandrel assembly including first and second telescoping tubes which are biased outwardly from each other by a spring mechanism located between them, the mandrel assembly being releasably mounted in a holder for holding a roll of material, the holder including a base and spaced, apart, outwardly extending first and second legs, each having a selected width, the mandrel assembly being releasably mounted between the legs, and a removable plate structure including a plate having an outer surface and an inner surface and having means for removeably mounting said plate onto one end of the mandrel assembly, said plate having an areal extent which extends beyond the width of the adjacent leg, whereby a user can easily engage said outer surface adjacent one leg with a thumb or finger and push the plate toward the other leg to compress the telescoping tubes to remove a used up roll of material, and said means for mounting comprises a sleeve which is fixed to and extends from said inner surface of said plate for being received at least part way over one of the telescoping tubes.

* * * * *